United States Patent [19]

de Broqueville

[11] 4,370,931

[45] Feb. 1, 1983

[54] TRANSPORTATION SYSTEM UTILIZING A STRETCHABLE TRAIN OF CARS AND STRETCHABLE BANDCONVEYORS

[76] Inventor: Axel de Broqueville, 2717 Stanford St., Dallas, Tex. 75225

[21] Appl. No.: 127,541

[22] Filed: Mar. 6, 1980

Related U.S. Application Data

[63] Continuation-in-part of Ser. No. 19,776, Mar. 12, 1979, abandoned.

[51] Int. Cl.[3] ..... A63G 1/00

[52] U.S. Cl. ..... 104/20; 104/25; 198/710

[58] Field of Search ..... 104/18, 20, 25, 183; 213/75 R; 198/110, 334, 792; 74/255 R; 308/239, 237

[56] References Cited

U.S. PATENT DOCUMENTS

| | | | |
|---|---|---|---|
| 3,462,002 | 8/1969 | Zuppiger et al. | 104/20 |
| 3,734,433 | 5/1973 | Metzner | 246/1 R |
| 3,834,520 | 9/1974 | Patin | 198/110 |
| 3,881,423 | 5/1975 | Woods et al. | 104/25 |
| 4,053,044 | 10/1977 | Patin | 198/334 |

FOREIGN PATENT DOCUMENTS

| | | |
|---|---|---|
| 1176444 | 5/1967 | France . |
| 2272873 | 12/1975 | France . |
| 2345329 | 10/1977 | France . |
| 397999 | 2/1966 | Switzerland . |

*Primary Examiner*—Richard A. Bertsch

*Attorney, Agent, or Firm*—Schwartz, Jeffery, Schwaab, Mack, Blumenthal & Koch

[57] ABSTRACT

A transportation system comprises a plurality of successive load carrying components, means for moving the components along a closed-loop path and means for controlling the speed of the components and their distance apart. The controlling means is operable by moving the components along the closed-loop path without rotation of the components traverse to the closed-loop path direction.

20 Claims, 16 Drawing Figures

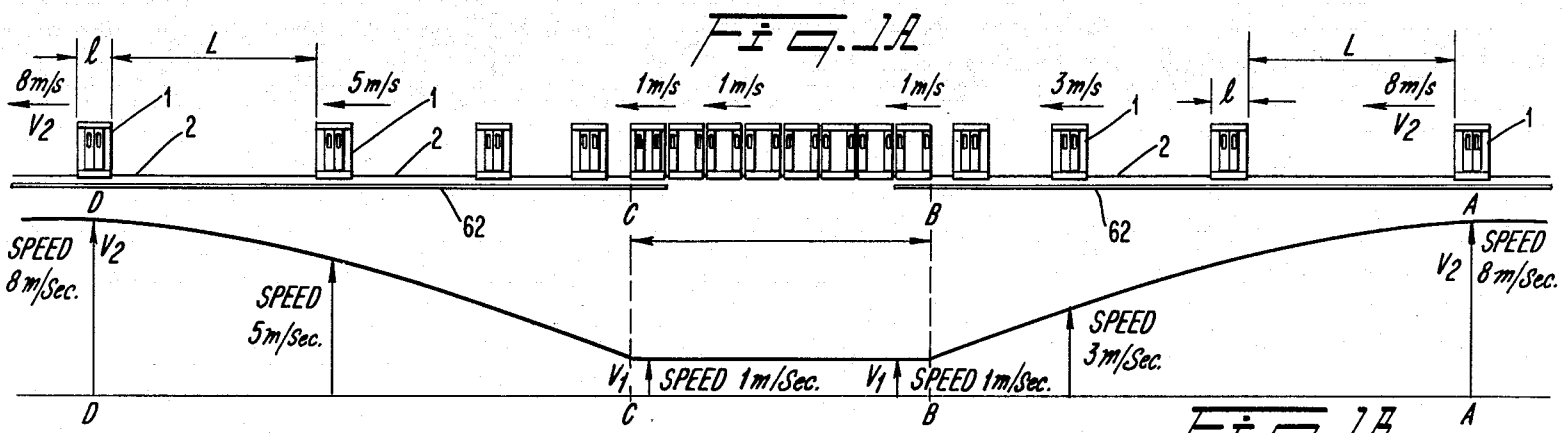
FIG. 1A
FIG. 1B
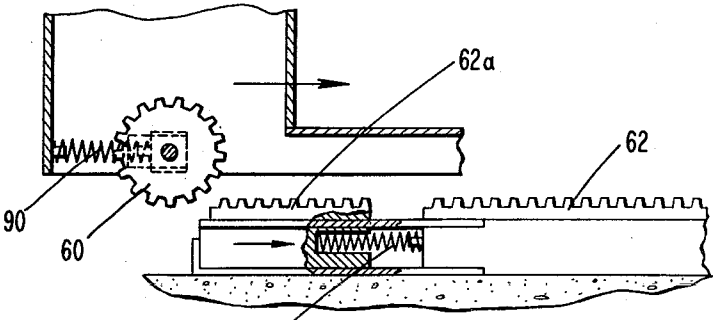
FIG. 5C
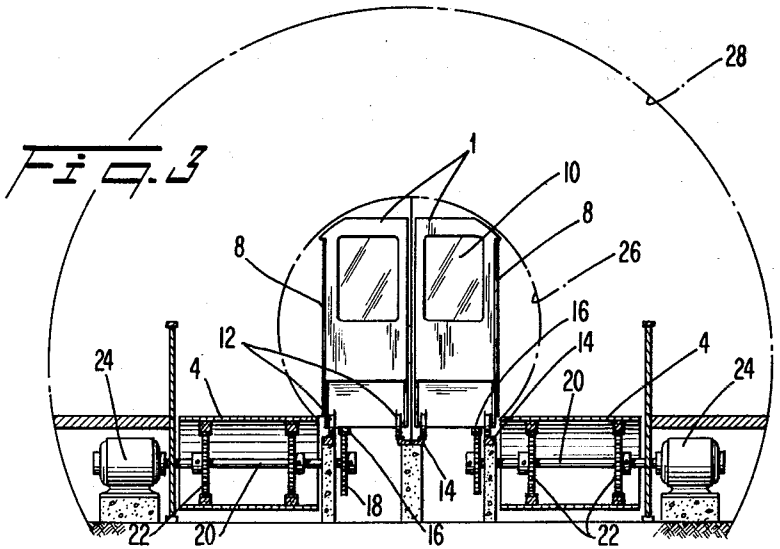
FIG. 3

100
102
103
104
105
106
107
111
150
170
A'
B'

100
102
103
104
105
106
107
108

TRANSPORTATION SYSTEM UTILIZING A STRETCHABLE TRAIN OF CARS AND STRETCHABLE BANDCONVEYORS

CROSS REFERENCE TO RELATED APPLICATION

This application is a continuation-in-part of copending application Ser. No. 19,776, filed Mar. 12, 1979, now abandoned.

BACKGROUND OF THE INVENTION

1. Field of the Invention

The present invention relates to conveying devices of which the components are linked together such that the distance between them varies as well as their speed.

2. Description of the Prior Art

The stretchable bandconveyor is a bandconveyor made of a succession of components sliding into or above each other and linked to each other by devices varying the distance between them such that the visible length and the speed of the components vary along their course.

The stretchable train of cars is an endless succession of cars linked to each other by devices varying the distance between them.

The stretchable and endless train of cars is used in combination with bandconveyors at loading/unloading stations where the speed of the cars and the distance between them is at a minimum and is synchronized over some distance with the speed of the bandconveyors in order to enable people to go from the bandconveyors to the cars and vice versa.

Several variable speed bandconveyors are known in the prior art. One such device uses components which are longer than they are wide. These components slide along each other, while the relative direction of motion progressively changes from a direction perpendicular to the long side of the components to a direction parallel to it, and therefore, the speed of the components varies proportionally to the ratio of their length and width. Another example of a rotating-type conveying apparatus is illustrated in U.S. Pat. No. 3,485,182. In another existing device components are driven by a single threaded rod with variable pitch.

Bandconveyors are also known which operate at constant speeds and go into or out of cars moving at the same speed. Usually, those cars are attached to a cable moving at constant speed, and the distance between them is fixed. These prior art devices do not utilize controllable means for coupling the components and/or cars to achieve variable speed and variable distance operation while maintaining the components aligned, i.e. unrotated, with respect to the closed-loop path followed by the components.

SUMMARY OF THE INVENTION

In accordance with the invention a transportation system is provided in which a continuous succession of components i.e. cars or bandconveyor elements travel in a closed circuit and are linked to each other by devices which control and vary the distance between them.

The cars are permanently moving, but before each loading/unloading station the distance between the cars is progressively reduced to a minimum by the devices linking them together. After each station, the distance between the cars is progressively increased by the same linking devices up to a maximum distance.

The action of increasing or reducing the distance between the cars will automatically increase or reduce the speed of the cars proportionally to the distance between the cars (including the car length). Therefore the speed of the cars is at a minimum at the station. The loading/unloading platform at the station consists of a bandconveyor moving at a speed which is synchronized with the minimum speed of the cars.

The linking devices may include arrangements of cables and winches, nuts and threaded rods, articulated rods or electronic distance measurement and servomechanisms as set forth hereinafter.

The endless train of cars can be started and kept in motion by motors at each station. These motors may also drive the bandconveyors and keep their speed synchronized with the speed of the cars at the stations. The power can be transmitted to the cars, e.g., by toothed wheels which engage racks which are fixed to each car. Small motors can be added to each car or some cars to compensate for drag due to the friction and reduce stresses on the linking devices.

To increase the capacity of the system, without increasing the width of the cars it is necessary to increase their minimum speed or the speed of the bandconveyors. In the latter case a stretchable bandconveyor may be made of components having linking means permitting the speed of the components to be progressively increased and decreased as described in relation to the train of cars. The succession of components are made to slide above or into each other to maintain a solid surface suitable for transport of passengers.

Such a stretchable bandconveyor can be used separately or in combination with the train of cars.

BRIEF DESCRIPTION OF THE DRAWINGS

FIG. 1A shows a schematic side view of a succession of cars before, within and after a station.

FIG. 1B shows a speed diagram showing the variations of the speed of the cars as a function of their location.

FIG. 3 shows a section of the station of FIG. 2.

FIG. 5C shows a modification of the embodiment of FIGS. 5A and 5B using a shock absorbing device.

FIG. 8A shows a partial view of the bottom of another embodiment of a stretchable bandconveyor.

FIG. 8B shows a sectional view of the bandconveyor of FIG. 8A taken along line BB thereof.

DETAILED DESCRIPTION OF THE PREFERRED EMBODIMENTS

FIG. 1A shows a lateral view of a succession of cars 1 moving from the right to the left. Linking devices 2, e.g. cables winded around winches, interconnected the cars to one another.

Starting from point A on the right, the cables are first completely unwound and the distance between the cars and the speed of the cars is a maximum. Between points A and B, the cables are progressively wound and the distance between the cars and therefore their speed is reduced.

Between points B and C is a station where the cars are loaded and unloaded. In the station the cables are completely wound up such that the cars are adjacent each other and move at the same speed which is synchronized with the speed of a bandconveyor (not shown) which moves along the cars to enable people to go into or get out of the cars.

After point C the cables are progressively unwound again and the distance between the cars and therefore their speed is progressively increased.

FIG. 1B shows the variation of the speed of the cars as a function of their location.

Figure 2:
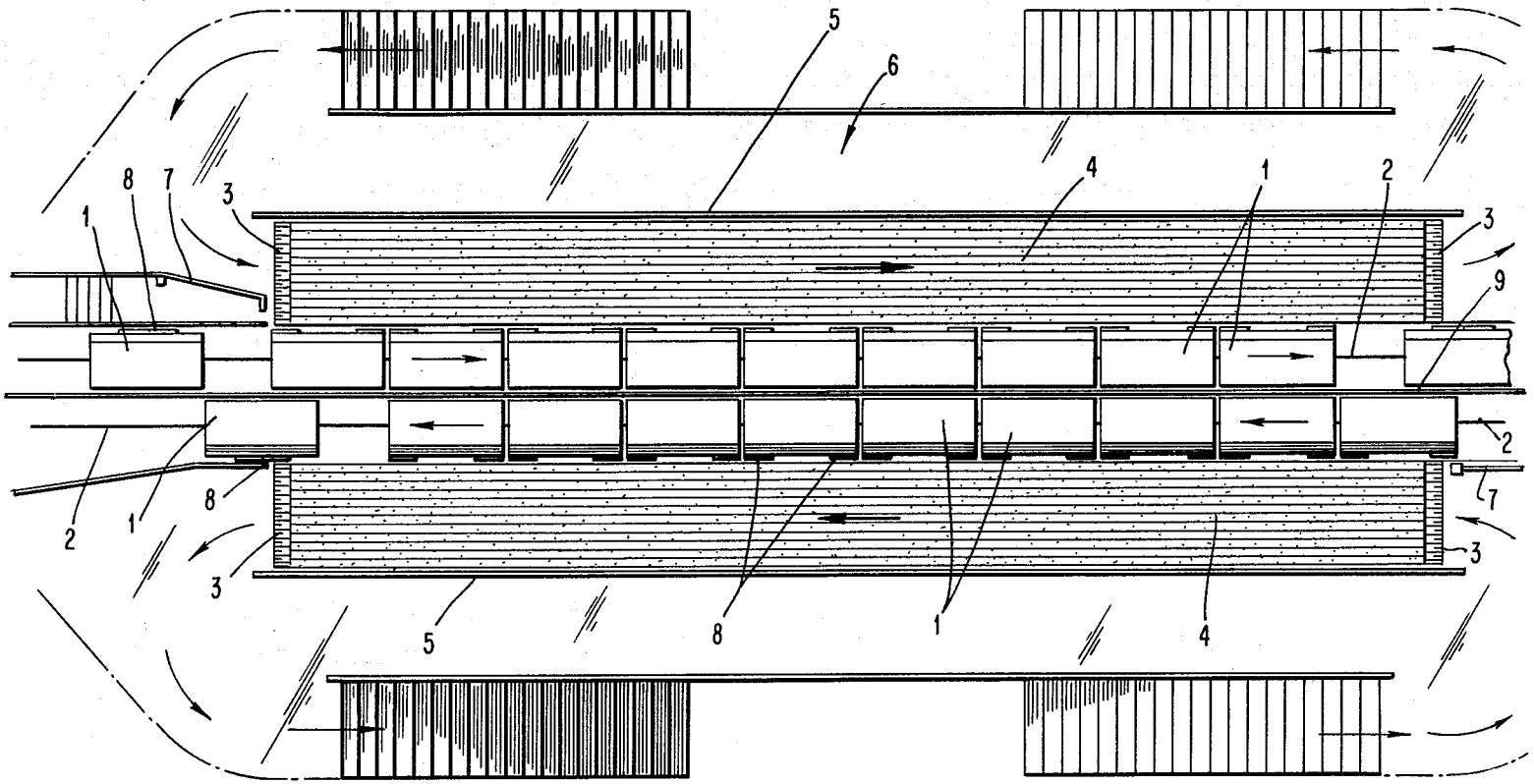
FIG. 2 shows a horizontal view of a station having two trains of cars going in opposite directions and two corresponding bandconveyors used as loading/unloading platforms.

FIG. 2 shows a horizontal view of two trains of cars 1 going in opposite directions between two bandconveyors 4 which enable people to go into or come out of the cars at a station 6. The cars are linked to each other by linking devices 2 such as cables winded around winches (not shown).

The cars have sliding doors 8 which are automatically opened and closed at the beginning and the end of the bandconveyors. The bandconveyors are endless belts equipped with hand rails 5 and devices 3 which prevent jamming between the station platform and bandconveyor. Safety rails 7 prevent people from putting their hands between cars entering into the station when the distance between them is being reduced to a minimum.

The two rows of cars are separated by a wall 9 to prevent the mixing of the two opposite air flows in order to reduce air drag.

FIG. 3 shows a section of the station wherein bandconveyors 4 are positioned on both sides of cars 1. The cars have sliding doors 8, windows 10 and wheels 12 rolling on rails 14.

Each car 1 has secured thereto a rack 16 driven by a toothed wheel 18 on the same shaft 20 as other wheels 22 which are used in driving bandconveyor 4. Shaft 20 is driven by a motor 24 which controls and synchronizes the speed of the cars 1 and bandconveyor 4 within the station 6.

Dotted lines 26 illustrate the section of a tunnel between stations, while dotted line 28 shows the section of the roof of the station.

Figure 4:
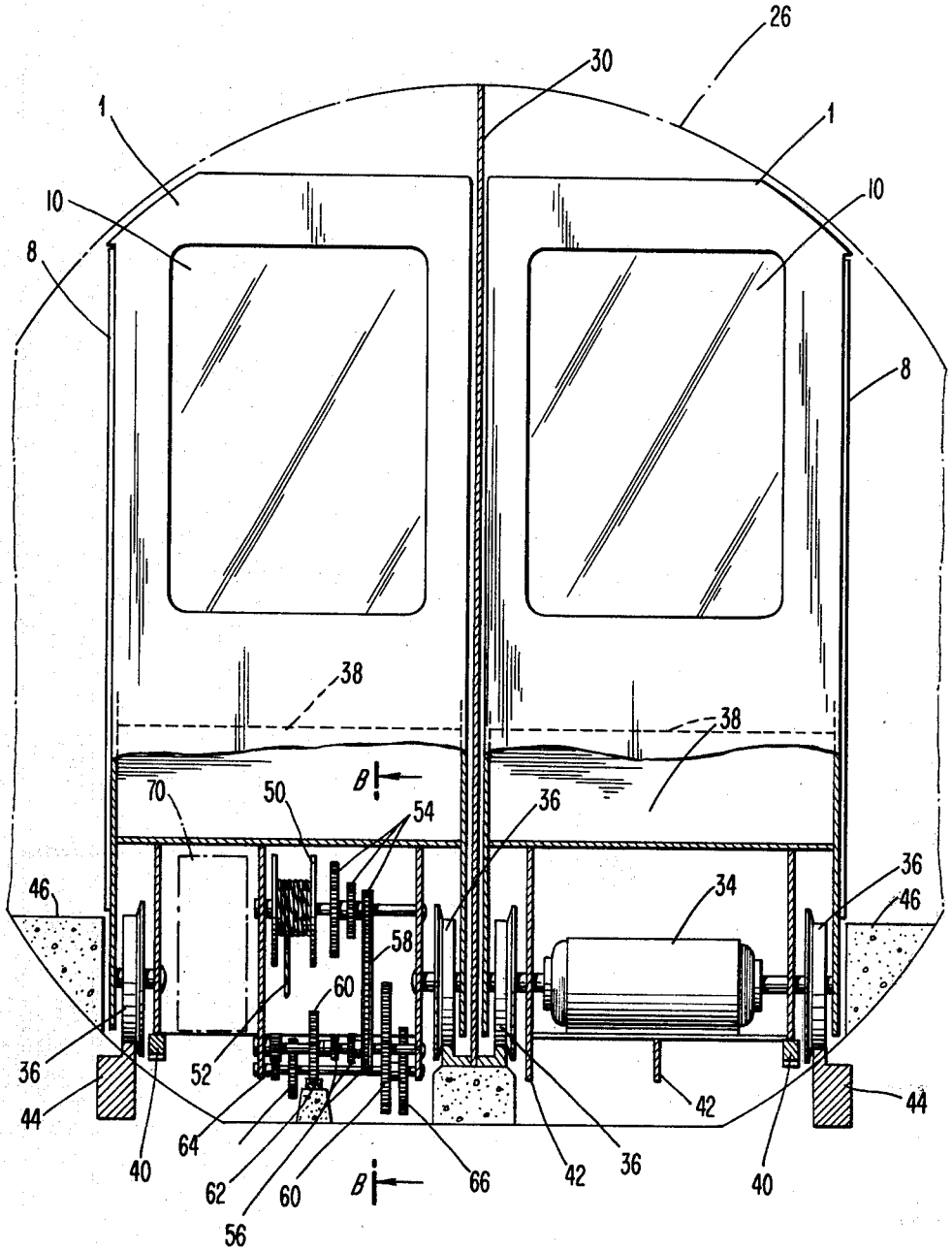
FIG. 4 shows an elevational view of the front and the rear of a car utilizing cables and winches driven by a set of gear-wheels.

FIG. 4 is an elevational view of two cars 1 inside a tunnel which is divided in two parts by a wall 30. The right car is seen from the rear side showing a motor 34 driving wheels 36 located under a bench 38. Motor 34 is used mainly to compensate for drag due to friction on the cars, since the energy of deceleration is automatically transmitted with very little loss by the winches and cables to accelerate the cars at the preceding station. A toothed rack 40, similar to rack 16 in FIG. 3, is used to synchronize the speed of car 1 with the speed of the bandconveyor at the station. Reinforcements 42 and rails 44 support and guide the cars. A platform 46 can be used as a walkway for maintenance or for emergency use.

The left car is seen from its front end showing a winch 50 with a part of a cable 52 linking the car to the next one. Two sets of toothed wheels 54 and 56 linked by a chain 58 are shown. Set 54 is on the same shaft as the winch 50, and set 56 is on the same shaft as two other toothed wheels 60 which are driven by a fixed rack 62 placed between the rails before a station. A third shaft supports a toothed wheel 64 driving the second shaft and two other toothed wheels 66 driven by fixed racks (not shown) and placed between the rails after each station.

The appropriate combination of the toothed wheels enables the winch to wind and unwind cable 52 at different speeds. If the fixed racks have in addition a variable path, it is possible to wind and unwind the winch at any desired speed, while using or reproducing a part of the kinetic energy of the car, regardless of the speed of the car. This can provide a relatively constant deceleration or acceleration. As an alternate solution, the winches can be winded and unwinded by motor placed on each car and started and stopped e.g. by a reed switch carried by the cars and activated by a magnet positioned adjacent the desired track position.

Space 70 is provided which can be used to house devices for automatically opening and shutting the sliding doors 8.

Figures 5A, 5B:
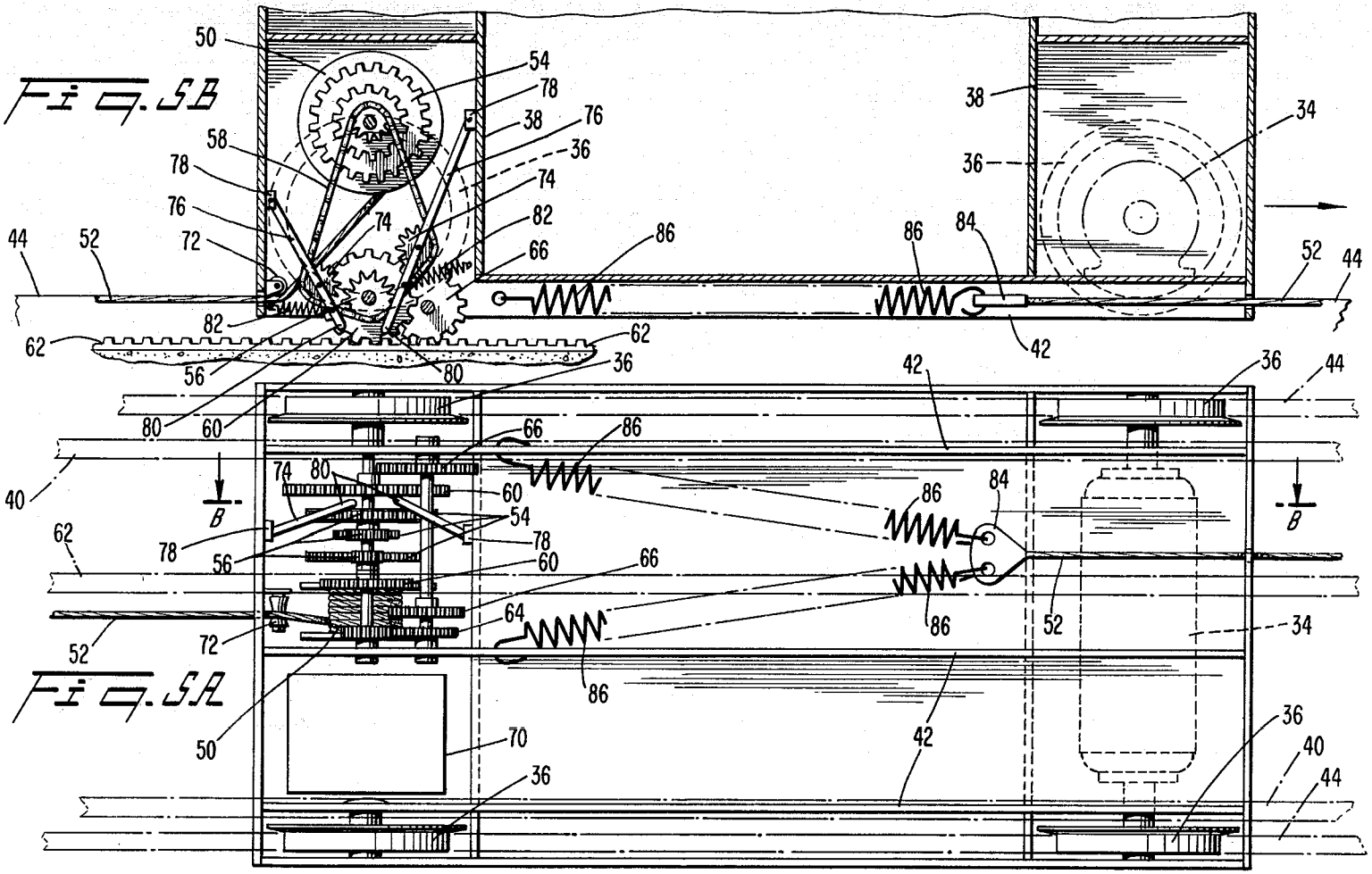
FIG. 5A shows a partial view of the bottom of the car shown in FIG. 4.
FIG. 5B shows a partial section of the car of FIG. 5A taken along the line BB thereof.

FIGS. 5A and 5B are other partial view of the same car of FIG. 4. FIG. 5A is a view of the bottom, and FIG. 5B is a partial view of a section of the car taken along line BB' of FIGS. 4 and 5A.

In addition to the elements shown on FIG. 4, FIG. 5 shows a grooved pulley 72 to guide the cable 52 on the winch 50 and two small toothed wheels 74 guiding the chain 58 on the different toothed wheels 54 and 56. Small wheels 74 are set in rods 76 of which one end 78 is articulated with the car, and the other end 80 is free to move and is guided by rails not shown on the figure in order to automatically set the appropriate transmission ratio between the fixed rack 62 and the winch 50. The free ends 80 of the rods 76 are linked to the car with a spring 82 which keeps the chains under tension.

The chain, rods and toothed wheels are, in fact, the various parts of a simple automatic gear-box for automatically coupling the fixed rack 62 with the mobile winch 50. Many other existing devices can be used for the same purpose.

The fixed end 84 of the cable 52 is linked to the next car by springs 86 in order to keep it constantly under tension. These springs also smooth the shock at the beginning and the end of the deceleration or acceleration and during gear changes.

The purpose of the different size wheels in the automatic gear box is to wind the winch at a relatively controlled speed in order to have a relatively constant acceleration and deceleration.

It may also be desirable to reduce the shock produced by contact of the large wheel 60 with the rack 62. To this end, the shaft of wheel 60 may be free to move in the direction parallel to the movement of the car and be maintained in a forward biased position by means of springs 90 as shown in FIG. 5C. Additionally, a short rack 62a may be provided in front of rack 62 and biased therefrom by means of a spring 92. Both springs 90 and 92 then help to dissipate the impact shock of wheel 60 with rack 62 or 62a.

Yet another alternative is to replace the toothed wheel 60 by a rubber wheel and the rack 62 by a concrete beam to permit a frictional drive means.

Figure 6A:
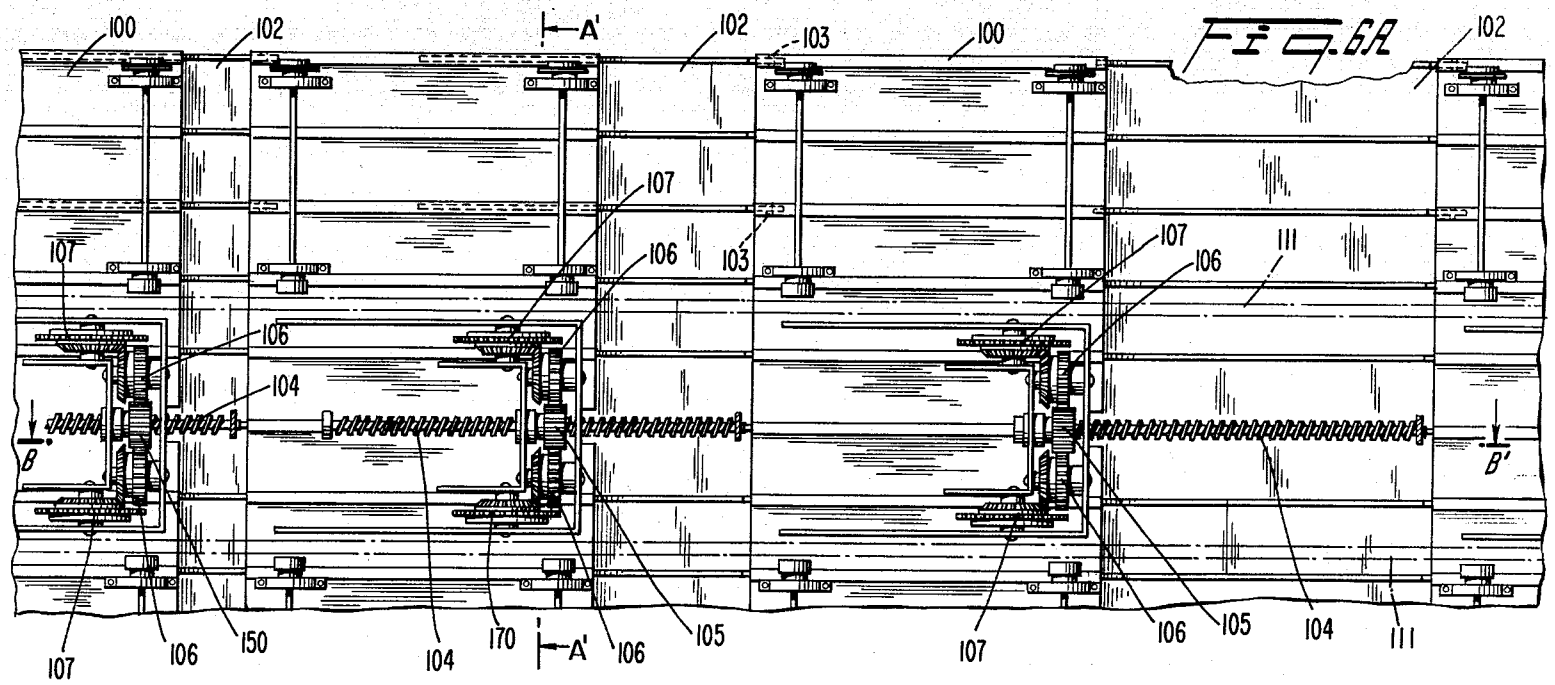
FIG. 6A shows a partial view of the bottom of an embodiment of a stretchable bandconveyor.
Figure 6B:
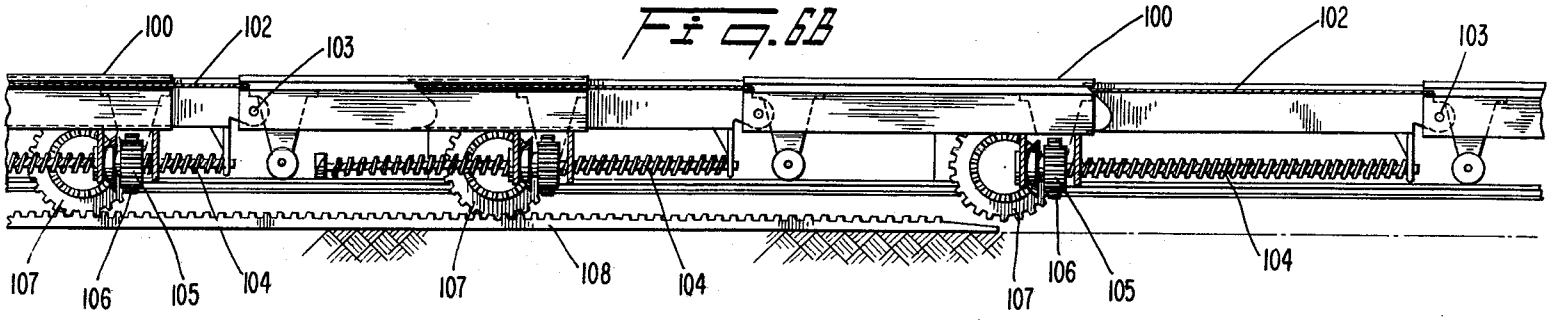
FIG. 6B shows a sectional view of the bandconveyor of FIG. 6A taken along line BB' thereof.

FIG. 6A is a partial view of the bottom of a bandconveyor made of a succession of alternating elements 100 and 102. FIG. 6B is a cross-sectional view of the bandconveyor taken along line BB' of FIG. 6A. Each element 102 slides into the element 100 on its left and is linked to the element 100 on its right by an articulation 103 in order to enable the bandconveyor to be bent. Each element 102 is also linked to its left element 100 by a threaded rod 104 of which one end is attached to the element 102, and the other end slides inside a nut 105 linked to the element 100. The nut 105 is screwed onto or off of the threaded rod 104 by means of gear wheels 106 and 107 driven by a fixed rack 108. The turning of the nut 105 on the threaded rod 104 decreases or increases the distance between the consecutive elements 100 and 102 and makes the corresponding elements 102 slide into or out of the element 100.

The bandconveyor is made of an endless succession of such elements 100 and 102 and the speed of these elements varies along their course proportionally to the distance between them. Fixed racks 108 are positioned in appropriate places along the path of the bandconveyor to achieve the desired speed of the elements and corresponding distance therebetween.

Figure 7:
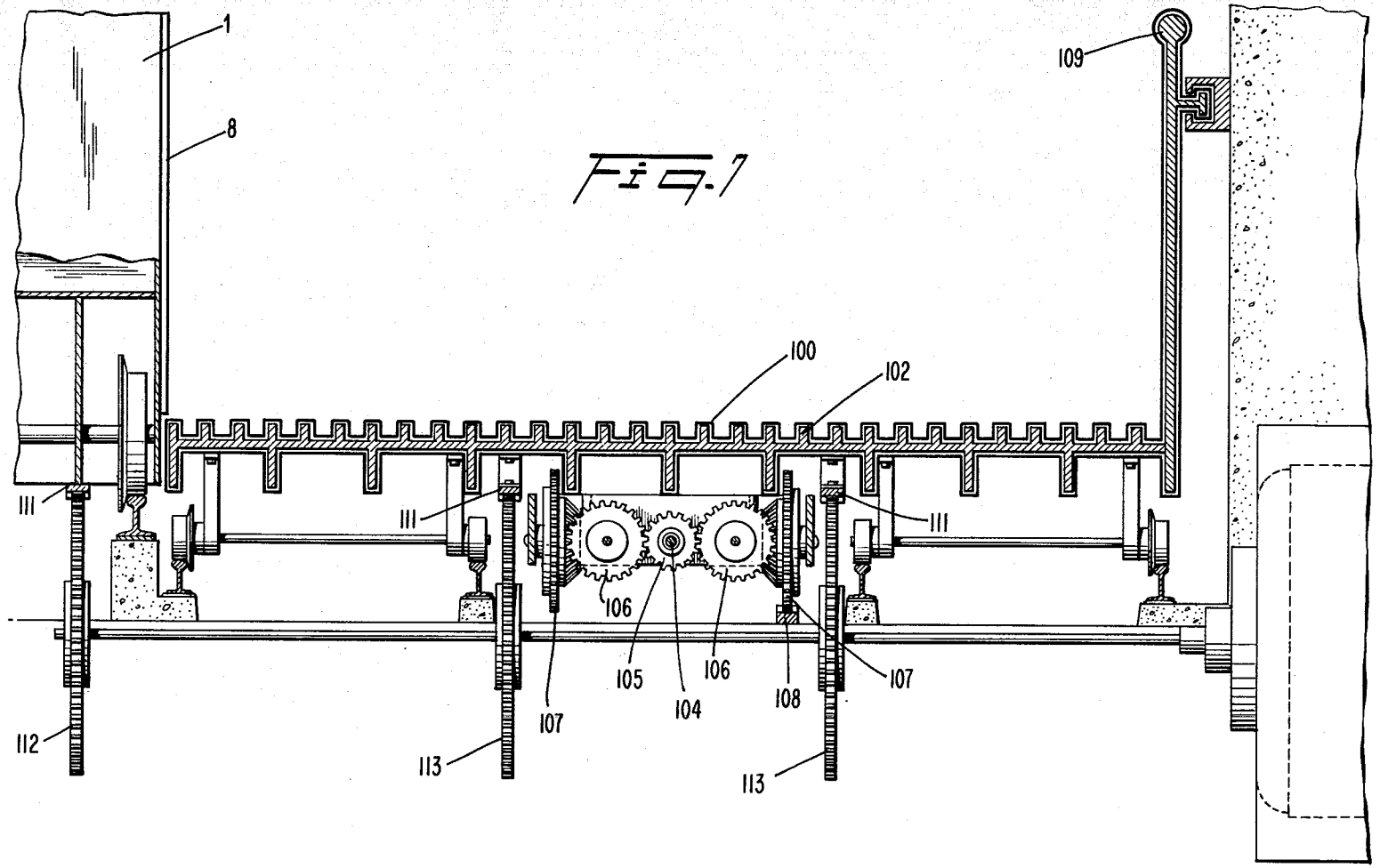
FIG. 7 shows a sectional view of the bandconveyor of FIG. 6A taken along line AA' thereof.
Figure 4A:
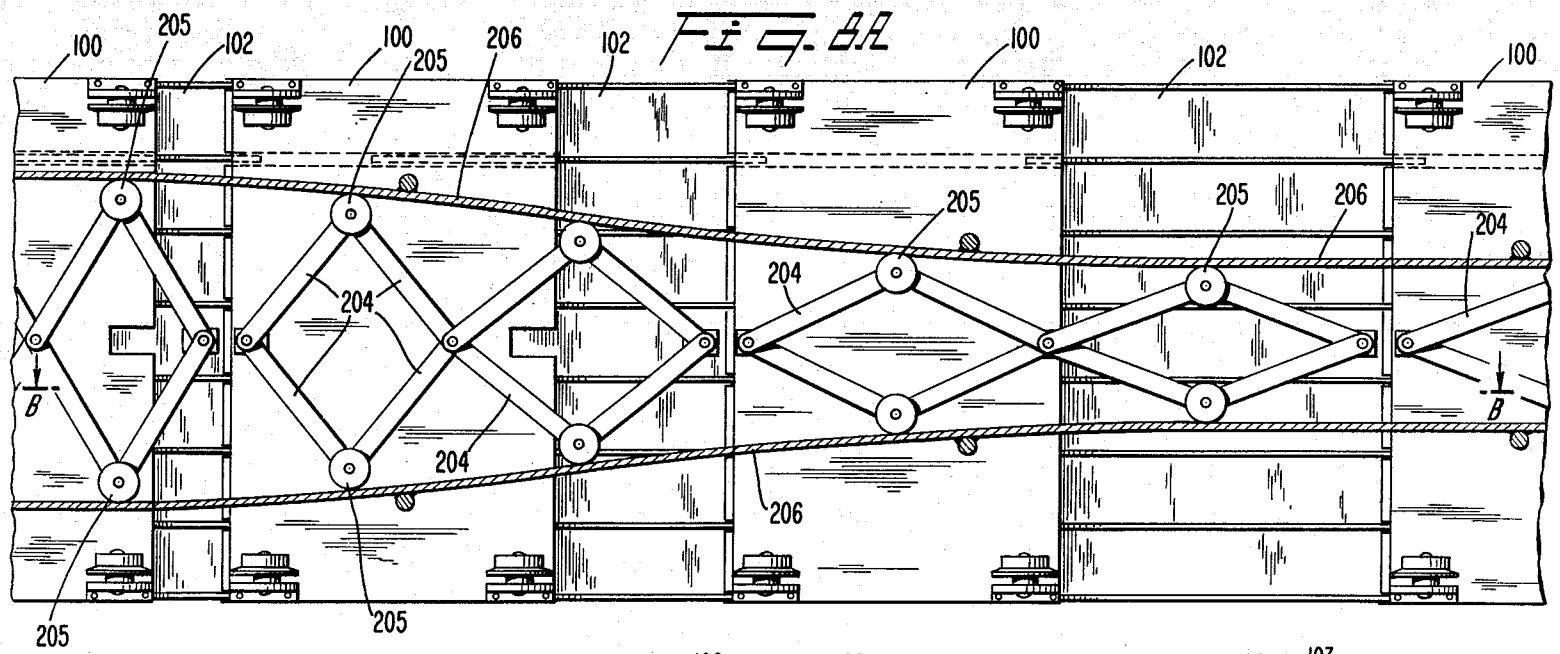
Figure 4B:
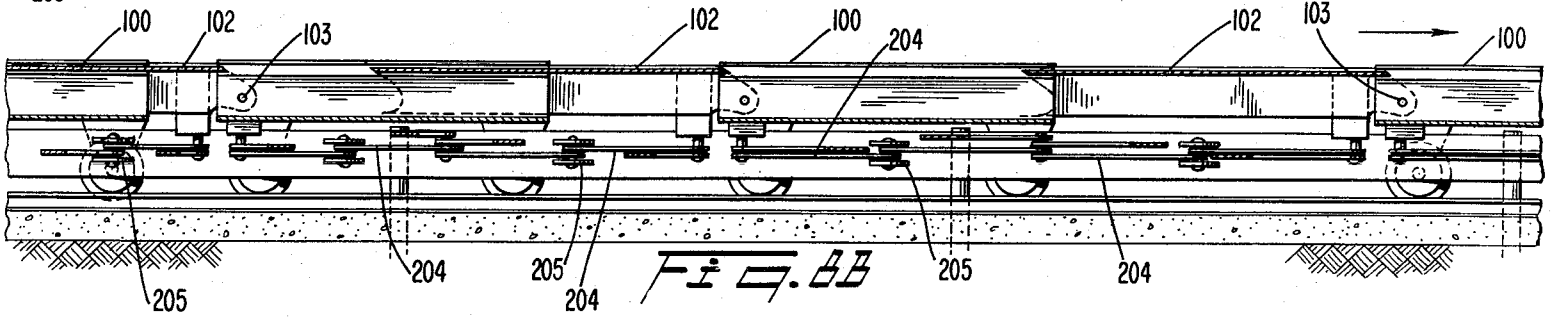

FIG. 7 is a sectional view of FIG. 6A along line AA' thereof. A hand rail 109 is made of telescoping elements which are fixed on the corresponding components 100 and 102. Car 1 such as described in FIG. 3 is also illustrated along with a device for synchronizing the speed of the car with the speed of the bandconveyor. This synchronizing device comprises racks 111 placed under and fixed to the car components and bandconveyor elements and gear wheels 112 and 113 located in the stations. Racks 111 are similar to racks 16 of FIG. 3 and 40 of FIG. 4.

FIGS. 8A and 8B are similar to FIGS. 6A and 6B except that the threaded rods 104, the nuts 105, the gear wheels 106 and 107 and the fixed rack 108 are replaced by articulated rods 204 with wheels 205 as shown, with wheels 205 guided by fixed rails 206, having a variable gap. The gap determines the distance between the consecutive elements 100 and 102.

The bandconveyor can be made of more than two alternating elements, one sliding into the other, if it is desired to increase the distance between the consecutive elements and therefore their speed by a factor larger than two. As an alternate solution, the bandconveyor can be made of elements sliding above each other.

It is understood that the embodiments described for controlling the speed and distance of the train of cars are also applicable for controlling the speed and distance of the bandconveyor elements and vise-versa.

Figure 9A:
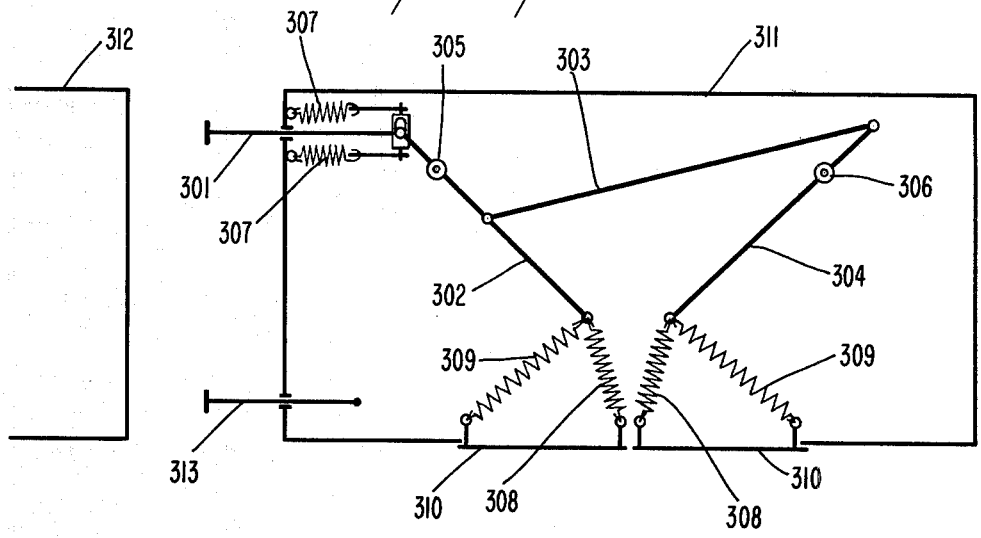
FIGS. 9A and 9B illustrate an arrangement of levers and springs for automatically opening and closing the car doors at a station.
Figure 9B:
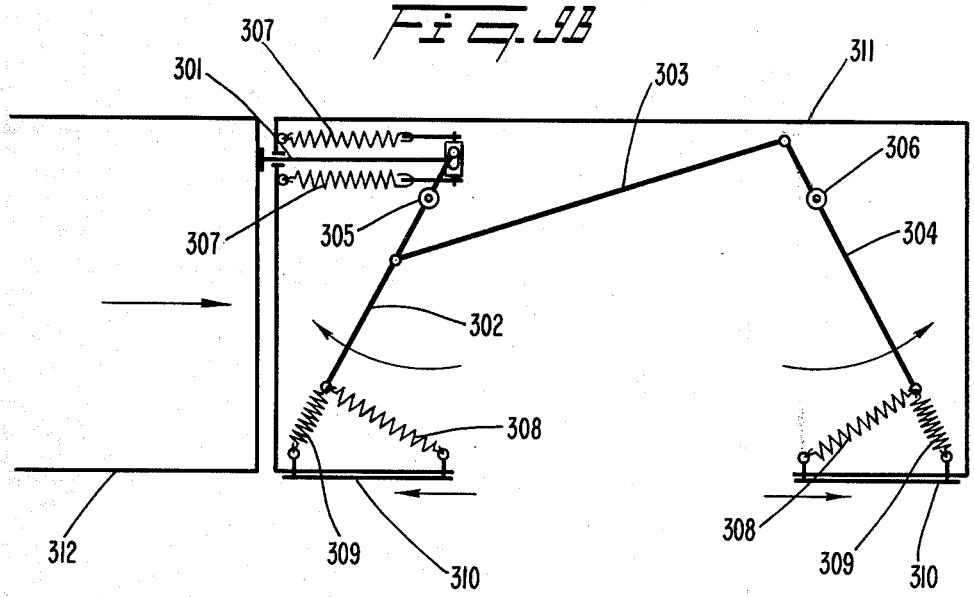

The cars 1 may also be provided with a device for automatically opening the car doors when the cars arrive at the station. Such a device is illustrated in FIGS. 9A and 9B. In FIG. 9A, doors 310 are shown in their closed position, whereas in FIG. 9B, the doors 310 are open. Cars 311 and 312 are illustrated together with levers 301, 302, 303 and 304 and springs 307, 308 and 309. When the cars 311 and 312 approach one another, lever 301 is pushed in thereby moving lever 302 around an axis 305. This in turn causes lever 303 to move lever 304 around its axis 306. The ends of levers 302 and 304 are linked to springs 308 and 309 to stretch springs 308 for opening the doors (FIG. 9B), and to stretch springs 309 to close the doors (FIG. 9A). Spring 307 biases lever 301 in the extended position (FIG. 9A) when the cars are apart.

Lever 313 may be utilized to lock the doors, and thereby prevent their opening, until the cars are sufficiently close together to insure speed synchronization with the bandconveyor. Any number of mechanisms may be employed for this purpose such as a single lever and lifter arrangement.

Figure 10:
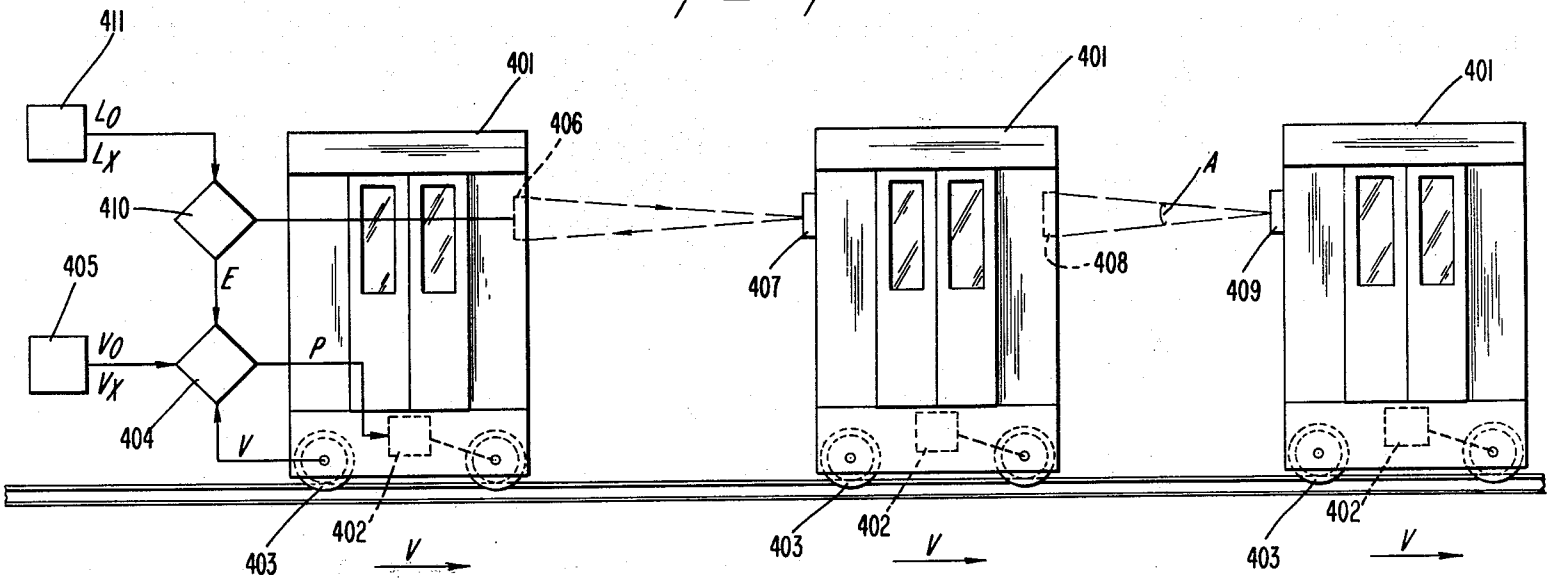
FIG. 10 illustrates a measuring apparatus and an electronic servomechanism for controlling the distance and speed of the train of cars.

FIG. 10 is a schematic diagram of means for controlling the distance and speed of cars 401 without mechanically interconnecting the cars. The system comprises a motor 402 contained within each car 401 for powering same. A servomechanism 404 is also provided which is connected to sense the speed of rotation of the car wheels 403 and compare same with a reference signal from reference source 405 and to provide an output control signal p to motor 402. Reference source 405 provides a reference signal $V_o$ when the cars are far apart and away from the station. At a specified point before a station, reference source 405 provides a signal $V_x$ which gradually reduces to a value $V_1$ representative of the minimum speed of cars 401 within the station. The output signal p to motor 402 enables the motor to drive the cars to match the desired speed $V_x$.

Elements 406 and 407 are utilized for measuring the distance between the cars 401. Element 406, for example, may be a sonar or radar transceiver which emits signals which are reflected by mirror 407 and received on the transceiver. Alternately, a laser beam may be utilized wherein a measure of the beam divergence angle A is proportional to the distance between cars as shown by elements 408 and 409 in FIG. 10. The output of element 406 is proportional to the instantaneous value of the distance between adjacent cars. This signal is fed to servomechanism 410 to be compared with a signal $L_x$ from distance reference source 411. The signal $L_x$ is representative of the theoretical value of the distance between cars. $L_x$ varies from a maximum of $L_o$ (cars far apart-away from station) to a minimum of $L_1$ (cars close-together-inside station). An error signal, E, from servomechansim 410 serves as an addition correction signal for servomechanism 404.

Reference sources 405 and 411 may be activated to change the reference signal from $V_o$ to $V_x$ and $L_o$ to $L_x$ respectively by a mechanical or electrical tripping device positioned adjacent the car path. The electrical tripping device may, for example, be a reed switch carried by the cars and activated by a magnet positioned adjacent the desired track position.

What is claimed is:

1. A transportation device comprising:

a plurality of successive load carrying components, one component sliding within an adjacent component, means for moving said components along a closed-loop path, and means for controlling the speed of said components and their distance apart, said controlling means operable by moving said components along said closed loop path without rotation of said components traversed to said closed-loop path.

2. A transportation device as recited in claim 1, wherein said controlling means comprises:

a plurality of sets of articulated rods;

each of said components attached to one end of at least one of said sets of articulated rods and the next said component attached to the opposite end of the same set of articulated rods;

two rails positioned along said path at a varying distance from one another;

at least some of the articulations of said same set of articulated rods sliding on said rails, such that the variations of the distance of said rails varies the distance between the ends of the same set of articulated rods and therefore the distance between consecutive components.

3. A transportation device as recited in any one of claims 1 or 2, further comprising spring biasing means connected between consecutive components for placing same under tension at least over a part of said path in order to prevent or reduce buckling or folding of said controlling means.

4. A transportation device as recited in any one of claims 1 or 2, wherein said components support a surface being for conveying loads, said surface expandable or contractable in length as said component distance increases or decreases thereby forming a bandconveyor.

5. A transportation device as recited in claim 1 further comprising a bandconveyor positioned at a station along said path for permitting passengers to go from said bandconveyor to said components and vice-versa; said controlling means varying the distance between said components to a minimum at said stations, and said device further comprising means for synchronizing the speed of said bandconveyor with the speed of said components at said station.

6. A transportation device as recited in claim 5, wherein said bandconveyor comprises:

a plurality of load carrying elements;

means for moving said elements along a closed-loop path; and means for controlling the speed of said elements and their distance apart, said controlling means operable by moving said elements along said closed-loop path without rotation of said elements traverse to said closed-loop path.

7. A transporation device as recited in claim 6, wherein said elements support a surface for conveying loads, said surface expandable or contractable in length as said element distance increases or decreases thereby providing an unbroken surface for passenger transport.

8. A transportation device as recited in claim 7, wherein said components are cars having doors thereon and said device further comprises means for automatically opening said doors when the distance between adjacent cars is at a minimum.

9. A transportation device as recited in claim 8, wherein said opening means comprises at least one lever extending outside said car for contact with an adjacent car when said cars move relatively close together and means for coupling said lever with said doors for opening same.

10. A transportation device as recited in claim 9, further comprising means for biasing said lever for extending outside said car and means for coupling said lever to said doors for automatically closing same when said cars move relatively far apart.

11. A transportation device as recited in claim 1, wherein said controlling means comprises winches and associated cables; means for attaching said components to one end of at least one said cable and the other end to an associated winch positioned in an adjacent component, such that the winding or unwinding of the winch reduces or increases the distance between consecutive components.

12. A transportation device of claim 11, wherein said winches are driven by sets of gear-wheels positioned in each said component, said gear-wheels driven by toothed wheels on said components and racks fixed along said path.

13. A transportation device as recited in claim 12, wherein said winches are driven by sets of gear-wheels positioned in each said component, said gear-wheels driven by a friction wheel on each component making contact with a rail fixed along said path.

14. A transportation device comprising:

a plurality of successive load carrying components, means for moving said components along a closed loop path, means for controlling the speed of said components and their distance apart, said controlling means operable by moving said components along said closed loop path without rotation of said components traversed to said closed-loop path, and said controlling means comprises:

threaded rods and nuts associated therewith;

means for attaching at least one of said moving components to one end of at least one threaded rod and the next component to at least one nut associated therewith; and means for rotating said nuts for increasing and decreasing the distance between consecutive components.

15. A transportation device as recited in claim 14, wherein said means for rotating said nuts comprises a set of gear wheels fixed to each of the said components, and a fixed rack positioned along said path, and gear wheels driven by said rack.

16. A transportation device as recited in claims 11 or 12 or 14 or 15, further comprising biasing means connected between consecutive components for placing same under tension at least over a part of said path in order to prevent or reduce buckling or folding of said controlling means.

17. A transportation device as recited in claims 11 or 12 or 14 or 15, wherein said components support a surface for conveying loads, said surface being expandable or contractable in length as said component distance increases or decreases thereby forming a bandconveyor.

18. A transportation device comprising:

a plurality of successive load carrying components, means for moving said components along a closed-loop path, means for controlling the speed of said components and their distance apart, said controlling means operable by moving said components along said closed loop path without rotation of said components traversed to said closed-loop path, and each of said components have motor means for moving same along said path and said controlling means comprises means for measuring the distance between adjacent components and means responsive to said measured distance for controlling said motor means for maintaining the distance between adjacent components within predetermined ranges along portions of said closed-loop path.

19. A transportation device as recited in claim 18, further comprising means for measuring the velocity of said components and means responsive to said measured velocity and said measured distance for controlling said motor means whereby the distance and velocity of each component may be individually controlled without mechanical interconnection of adjacent components.

20. A transportation device comprising:

a plurality of successive load carrying components, means for moving said components along a closed-loop path, means for controlling the speed of said components and their distance apart, said controlling means operable by moving said components along said closed loop path without rotation of said components traversed to said closed-loop path, and each of said components have motor means for moving same along said path and said controlling means comprises means for measuring the velocity of said component and means responsive to said measured velocity for controlling said motor means for maintaining the velocity of said components within predetermined ranges along portions of said closed-loop path.

* * * * *